United States Patent [19]

Taylor

[11] 4,210,490

[45] Jul. 1, 1980

[54] METHOD OF MANUFACTURING PAPER OR CARDBOARD PRODUCTS

[75] Inventor: John H. Taylor, St. Austell, England

[73] Assignee: English Clays Lovering Pochin & Company, Limited, St. Austell, England

[21] Appl. No.: 970,973

[22] Filed: Dec. 19, 1978

Related U.S. Application Data

[63] Continuation-in-part of Ser. No. 813,512, Jul. 7, 1977, abandoned.

[51] Int. Cl.[2] ..... D21H 3/28

[52] U.S. Cl. ..... 162/175; 162/181 D; 162/183

[58] Field of Search ..... 162/175, 178, 181 R, 162/181 A, 181 C, 181 D, 181 B, 183; 106/308 C, 288 B

[56] References Cited

U.S. PATENT DOCUMENTS

| | | | |
|---|---|---|---|
| 3,052,595 | 9/1962 | Pye | 162/181 D |
| 3,257,267 | 6/1966 | Hay | 162/183 |
| 3,342,732 | 9/1967 | Goetz | 162/178 |
| 3,873,336 | 3/1975 | Lambert et al. | 162/175 |
| 4,115,187 | 9/1978 | Davidson | 162/175 |

FOREIGN PATENT DOCUMENTS

| | | | |
|---|---|---|---|
| 603061 | 8/1960 | Canada | 162/181 R |
| 2516097 | 6/1975 | Fed. Rep. of Germany | 162/181 A |

OTHER PUBLICATIONS

Casey "Pulp & Paper", vol. II, (1960), pp. 1007–1009.

*Primary Examiner*—S. Leon Bashore
*Assistant Examiner*—Peter Chin
*Attorney, Agent, or Firm*—Weingram & Klauber

[57] ABSTRACT

Paper or cardboard products are manufactured by mixing an aqueous solution or dispersion of a cationic starch with an aqueous suspension of a kaolinitic clay filler, and adding the resulting mixture to a stock of cellulosic fibres to form a furnish containing the kaolinitic clay filler, the cationic starch and the cellulosic fibres, which furnish is then formed into the desired paper or cardboard products, the amount of shear to which the mixture containing the clay filler and cationic starch is subjected being controlled to ensure that the furnish contains flocs of clay filler and cationic starch of a desired size.

8 Claims, 1 Drawing Figure

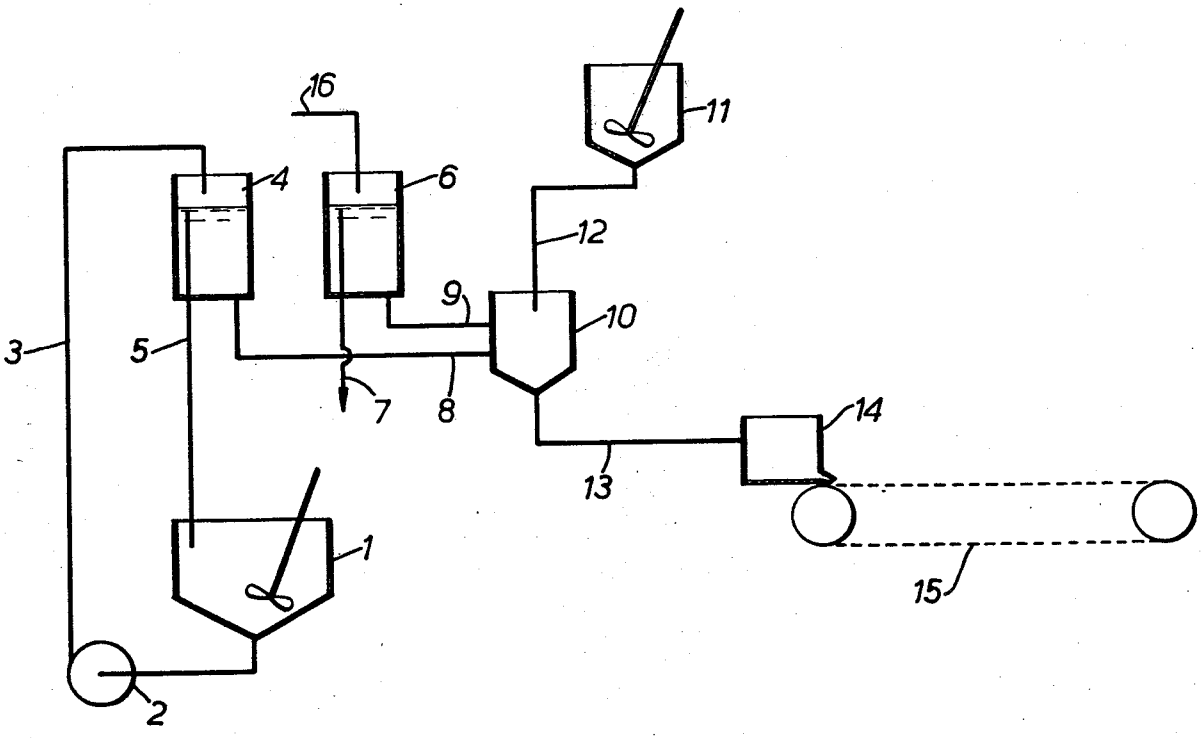
1
2
3
4
5
6
7
8
9
10
11
12
13
14
15
16

METHOD OF MANUFACTURING PAPER OR CARDBOARD PRODUCTS

This application is a continuation-in-part of my copending application Ser. No. 813,512 filed July 7th, 1977, entitled METHOD FOR IMPROVING STRENGTH OF PAPER AND CARDBOARD PRODUCTS, now abandoned which application is assigned to the assignee of the present application.

BACKGROUND OF THE INVENTION

This invention relates to the manufacture of paper and cardboard products and, more particularly, is concerned with a method of manufacturing paper and cardboard products which have improved strength characteristics.

Paper and cardboard products are generally made by pouring an aqueous stock of cellulosic fibres on to a wire mesh screen formed from a metal or a synthetic plastics material, and removing the water by drainage and/or other means such as suction, pressing and thermal evaporation. The cellulosic fibres are generally derived from wood which has been mechanically and chemically treated to form a pulp of fibrillated fibres which, when deposited on the wire mesh screen, interlock to produce a web, thus forming a paper or cardboard product. Other sources of cellulosic fibres include sisal, esparto, hemp, jute, straw, bagasse, cotton linters and rags.

The addition of a white filler to the cellulosic fibres improves the opacity, whiteness and ink receptivity of paper or cardboard products which are formed from the fibres. The white filler is also cheaper than the cellulosic fibres and therefore replacing some of the cellulosic fibres with the white filler can result in a cheaper product. The white filler may be, for example, kaolin, calcium sulphate, calcium carbonate, talc, silica or a synthetic silicate. The particle size distribution of a filler has an effect on its properties: on the one hand a filler which contains a significant proportion of relatively coarse particles may contain hard mineral impurities such as quartz or feldspar which makes the paper or cardboard product containing such a filler abrasive with consequent wear of type face and printing machinery; and on the other hand a filler which contains a significant proportion of relatively fine particles, i.e. particles having an equivalent spherical diameter smaller than about 2 μm, has the disadvantage that the strength of the paper or cardboard product incorporating such a filler is reduced and in addition, unless expensive retention aids are used, a proportion of the filler which is added to the stock of cellulosic fibres tends not to be retained in the web of fibres but escapes with the "white water". i.e. the water which drains through the web and through the mesh screen, thus creating the problem of recovering the mineral particles before the effluent water can be discharged. Many retention aids, including aluminium sulphate, mannogalactans, starch and starch derivatives, have been incorporated in the furnish of filler and cellulosic fibres with a view to binding the filler to the cellulosic fibres.

SUMMARY OF THE INVENTION

According to the present invention there is provided a method of manufacturing a paper or cardboard product of improved strength characteristics which method comprises in sequence the steps of mixing an aqueous solution or dispersion of a cationic starch with an aqueous suspension of a kaolinitic clay filler to form a mixture containing flocs of starch and clay filler; thereafter adding the mixture thus obtained to an aqueous stock of cellulosic fibres to form a furnish containing the flocs of starch and clay filler, and the cellulosic fibres; and then forming the furnish into a paper or cardboard product; wherein the product of the rate at which shear is applied to, and the period for which shear is applied to, said flocs during the formation of said mixture and said furnish is such that the flocs in said mixture are reduced in size sufficiently to enable substantially all of the mixture to pass through a No. 200 mesh British Standard sieve but not so much that more than 90% of the mixture can pass through a No. 300 mesh British Standard sieve.

The cationic starch carries positive charges which improve bonding to the cellulosic fibres. Preferably, the cationic starch carries primary, secondary or tertiary amino groups or quarternary ammonium groups. The degree of cationicity (generally expressed in terms of the nitrogen content of the starch) is important: starches having a nitrogen content between 0.1 and 0.25% by weight are particularly effective. It also appears that as the molecular weight of the starch is increased so the effect on the strength of the paper is improved, although the viscosity of a suspension of the starch increases.

The quantity of cationic starch used will generally be in the range from about 1% to about 20% by weight, preferably from 2% to 10% by weight, based on the weight of dry kaolinitic clay filler; and there will generally be present in the paper or cardboard product from about 0.5 to about 5.0 g of cationic starch, preferably from 1 to 3.5 g of cationic starch per 100 g of dry furnish, i.e. cellulosic fibres and clay filler.

A further improvement in strength may also be achieved if both the aqueous stock of cellulosic fibres and the aqueous suspension of kaolinitic clay filler are treated with the cationic starch before they are mixed together. The total amount of cationic starch used will again generally be in the range of from 0.5 g to 5.0 g of starch per 100 g of dry furnish.

The strength of the paper or cardboard product which is formed from the mixture of kaolinitic clay filler, cationic starch and cellulosic fibres is increased if the proportion of very fine particles in the clay filler is reduced. Generally, the filler should contain not more than 50% by weight of particles having an equivalent spherical diameter smaller than 2 μm and not more than 35% by weight of particles having an equivalent spherical diameter smaller than 1 μm. If the whiteness of the paper or cardboard product is not important, the proportion of fine particles can be reduced still further to obtain a further increase in strength characteristics; thus in this case it is preferred if the filler contains not more than 18% by weight, and most preferably not more than 15% by weight, of particles having an equivalent spherical diameter smaller than 2 μm, and not more than 10% by weight of particles having an equivalent spherical diameter smaller than 1 μm. It is also deleterious for the clay filler to contain a large proportion of particles having an equivalent spherical diameter greater than 10 μm. Generally, therefore, the clay filler will contain less than 35% by weight of particles larger than 10 μm, and preferably the clay filler will contain not more than 25% by weight of particles larger than 10 μm.

The amount of clay filler used in the method of the invention will generally lie in the range of from about 5% to about 30% by weight. However, the method of the invention is of particular value when there is used at least 20% by weight of clay filler, based on the weight of dry furnish, since it is then possible to achieve a significant saving in costs without a reduction in the strength characteristics of a paper or cardboard product.

In order to obtain the highest strength in a paper or cardboard product manufactured according to the method of the invention, it is important that the product of the rate at which shear is applied to, and the period for which shear is applied to, the mixture of the kaolinitic clay filler and cationic starch should be neither too low nor too high. On mixing an aqueous solution or dispersion of a cationic starch with an aqueous suspension of a kaolinitic clay filler the particles of filler are flocculated and bound to each other in such a way that the flocs are themselves subsequently bound to the cellulosic fibres. The product of the rate at which shear is applied to, and the time for which shear is applied to, the mixture of kaolinitic clay filler and cationic starch should not be so low that the floc structure is not broken down sufficiently to enable substantially all of the starch/filler mixture to pass through a No. 200 mesh British Standard sieve (nominal aperture 76 μm) nor should it be so high that the floc structure is broken down to the extent that the particle size of the starch-/filler mixture is approximately the same as that of the untreated filler so that substantially all of the mixture (i.e. at least 90%) can pass through a No. 300 mesh British Standard sieve (nominal aperture 53 μm). If the floc structure is not broken down to the extent noted above a paper containing the filler is unacceptable because of lumps of undispersed filler and, on the other hand, if the floc structure is broken down too much the treated filler would give no improvement in the strength of the filled paper as compared with an untreated filler. The product of the rate at which shear is applied to, and the period for which shear is applied to, the mixture of kaolinitic clay filler and cationic starch is important not only in the operation of mixing the starch with the filler but also in subsequent operations such as that of mixing the starch/filler mixture with the cellulosic fibres.

The product of the rate at which shear is applied to, and the period for which shear is applied to, the mixture of kaolinitic clay filler cationic starch should preferably be such that the flocs in the flocculated suspension of the mixture of clay filler and cationic starch have a floc size distribution, as measured by means of an optical microscope following the procedure set out in British Standard 3406: Part 4, 1963, such that not more than 15% by weight of the flocs have a diameter smaller than 10 μm, and not more than 20% by weight have a diameter larger than 60 μm. Preferably from 30% to 80% by weight of the flocs should have a diameter smaller than 30 μm. Most preferably not more than 10% by weight of the flocs should have a diameter smaller than 10 μm, at least 40% by weight should have a diameter smaller than 30 μm, and not more than 10% by weight should have a diameter larger than 60 μm.

The floc size distribution is determined (in accordance with British Standard 3406: Part 4, 1963) by taking a 1 ml sample of the suspension of the mixture of clay filler and cationic starch, diluting the sample one thousand times with water, filtering a 5 ml sample of the diluted suspension under vacuum on to a 50 mm diameter cellulose acetate membrane of pore size 0.2 μm, transferring the membrane to the surface of a microscope slide, rendering the membrane completely transparent with a mixture of dioxan and butanol, and allowing the surface of the slide to dry. A rectangular field comprising a small part of the total area of the dried suspension is then examined under the microscope and, by comparison with a graticule provided with circles of appropriate size, the number of flocs in the field having a diameter respectively smaller than 10 μm, larger than 10 μm but smaller than 30 μm, larger than 30 μm, but smaller than 60 μm, and larger than 60 μm is determined. The slide carrier of the microscope is then moved to expose a different field and the count of flocs in the above size ranges is repeated. The count is repeated for a number of different fields chosen at random and the average number of flocs in each of the above size ranges is determined.

The invention is illustrated by the drawing and by the following Examples.

EXAMPLE 1

For the experiments described in this Example the apparatus shown schematically in the accompanying drawing was employed.

A. An aqueous stock containing 2% by weight of cellulosic fibres (obtained by beating and refining a bleached sulphite pulp) was mixed in a stirred tank 1 with 1.5% by weight, based on the weight of dry cellulosic fibres, of fortified rosin size and 3.0% by weight of powdered aluminium sulphate. The resulting stock of sized fibres was delivered by a pump 2 through a conduit 3 to a constant head tank 4 from which the overflow returned to tank 1 through a conduit 5. Clean water was supplied via a conduit 16 to a second constant head tank 6 from which the overflow passed through a conduit 7 to a reservoir (not shown).

The stock of sized fibres flowed from tank 4 through a conduit 8, and water flowed from tank 6 through a conduit 9, to a tank 10 where they were mixed in the proportions 3 parts by weight of water to 1 part by weight of suspension to dilute the stock to 0.5% by weight of cellulosic fibres.

In a tank 11 provided with an impeller there were mixed together, in batches of approximately 8 liters each, water, a china clay filler in a flocculated state and a cationic starch containing tertiary amine groups. The tank 11 had a diameter of 300 mm, and the impeller had a diameter of 80 mm and a speed of 1,500 rpm. The cationic starch was added to the suspension of china clay filler in water over a period of 1 minute with constant stirring, and the stirring was then continued for a further 2 minutes. The speed of the impeller was such that a vortex was just formed in the tank 11. The china clay filler had a particle size distribution such that 25% by weight consisted of particles having an equivalent spherical diameter larger than 10 μm and 20% by weight consisted of particles having an equivalent spherical diameter smaller than 2 μm. The starch was added in the proportion of 5% by weight, based on the weight of dry clay. The rate at which shear was applied to, and the period for which shear was applied to, the mixture of water, china clay filler and cationic starch was such that less than 10% by weight of the flocs in the mixture had a diameter smaller than 10 μm, at least 40% by weight of the flocs in the mixture had a diameter smaller than 30 μm, and not more than 10% by weight of the flocs had a diameter larger than 60 μm.

The mixture of clay filler and starch was run through a conduit 12 to the tank 10 and was mixed with the stock of sized fibres with the minimum amount of shear which would give a uniform mixture in different proportions so as to give four batches providing different loadings of china clay in the final dry paper. The resulting mixtures were run through a conduit 13 to the head box 14 of a Fourdrinier paper making machine 15 where, for each loading of clay, a web of paper was formed on the wire, dewatered and thermally dried.

Samples of the paper web for each loading of clay were weighed dry and then incinerated and the weight of ash was used to calculate the percentage by weight of clay in the dry paper, after allowing for the loss on ignition of the clay.

Other samples of each paper web were tested for burst strength by the test prescribed in TAPPI Standard T403-os-74, the burst strength being defined as the hydrostatic pressure, in kilonewtons per square meter, required to produce rupture of the materal when the pressure is increased at a controlled constant rate through a rubber diaphragm to a circular area 30.5 mm in diameter with the area of the material under test being initially flat and held rigidly at the circumference but free to bulge during the test.

B. A second batch of sample papers was prepared in a manner similar to that described in A above except that the cationic starch was mixed with the stock of cellulosic fibres and with the size and aluminium sulphate in stirred tank 1 and not with the clay filler in tank 11. The amount of starch used was 2% by weight based on the weight of dry cellulosic fibes. The stock was diluted with water in tank 10, as in A, and different quantities of an aqueous suspension of the same china clay filler were added to give four batches providing different loadings of the clay filler. During the mixing of the china clay filler and the stock in tank 10 sufficient energy was used just to set up a vortex in the tank, each batch being mixed for a total time of three minutes. A web of paper was formed for each loading of clay filler and measurements of the percentage by weight of clay in the dry paper and of the burst strength were made.

C. A third batch of paper samples was prepared in a manner similar to that described in A above except that the china clay filler was mixed with the stock of fibres and with the size and aluminium sulphate in stirred tank 1. Again the quantities of china clay filler used were varied to give four batches providing different loadings of clay in the final paper. The stock was diluted with water in tank 10, as in A, and a solution of the cationic starch was run in from stirred tank 11 in a quantity sufficient to provide 5% by weight of starch based on the weight of clay. During the mixing of the cationic starch and the stock in tank 10 sufficient energy was used just to set up a vortex in the tank. A web of paper was formed for each loading of clay and measurements of the percentage by weight of clay in the dry paper and of the burst strength were made.

D. A fourth batch of paper samples was prepared in a manner similar to that described in A above except that no tertiary cationic starch was added. The stock of fibres, size and aluminium sulphate were mixed in stirred tank 1 and the mixture was diluted with water in tank 10, as in A, and again different quantities of china clay filler were added in tank 10 to give four different loadings of the clay in the final paper. A web of paper was formed for each loading of clay and measurements of the percentage by weight of clay in the dry paper and of the burst strength were made.

The results of Tests A, B, C and D are set forth in Table 1 below. The burst strength figures were expressed as a percentage of the burst strength of a sized paper web which contained no filler and no starch and the resultant relative burst strengths were plotted graphically against the percentage by weight of clay in the web. From the graphs thus obtained the relative burst strengths corresponding to clay filler loadings of 10%, 17.5% and 25% by weight were found for each batch of paper. Table 1 also gives the percentage by weight of cationic starch based on the weight of dry furnish (total weight of clay and fibres) for each web of paper.

TABLE I

| | A | | B | | C | | D | |
|---|---|---|---|---|---|---|---|---|
| Clay loading % by wt. | Relative Burst strength | % by wt. of starch on dry furnish | Relative Burst strength | % by wt. of starch on dry furnish | Relative Burst strength | % by wt. of starch on dry furnish | Relative Burst strength | % by wt. of starch on dry furnish |
| 10 | 88 | 0.50 | 111 | 1.80 | 85 | 0.50 | 75 | 0 |
| 17.5 | 79 | 0.88 | 89 | 1.65 | 74 | 0.88 | 56 | 0 |
| 25 | 70 | 1.25 | 66 | 1.50 | 63 | 1.25 | 41 | 0 |

The results show that at high clay filler loadings mixing the cationic starch with the clay filler and then adding the starch/clay mixture to the suspension of sized cellulosic fibres gives an unexpectedly high strength value for the resultant paper for a given weight of cationic starch per 100 g of dry furnish.

EXAMPLE 2

Further batches of paper were made according to the method described in Example 1A, (using the same apparatus) except that the proportion of cationic starch mixed with the china clay in stirred tank 11 was varied for each batch, the proportions of starch being 5%, 7.5%, 10%, 15% and 20% by weight, respectively, based on the weight of dry clay. For each proportion of starch to clay, webs of paper were formed containing three different loadings of starch-treated clay filler. Samples of each web were tested for burst strength and the percentage of clay filler in the dry paper. The results were plotted graphically and the relative burst strength for a loading of 20% by weight of dry clay based on the weight of dry fibres was found for each batch of paper. The results obtained are set forth in Table II below.

TABLE II

| % by weight of starch on clay | % by weight of starch on furnish | Relative Burst strength for a clay filler loading of 20% by weight |
|---|---|---|
| 5 | 1.0 | 74 |
| 7.5 | 1.5 | 77 |
| 10 | 2.0 | 79 |
| 15 | 3.0 | 82 |

TABLE II-continued

| % by weight of starch on clay | % by weight of starch on furnish | Relative Burst strength for a clay filler loading of 20% by weight |
|---|---|---|
| 20 | 4.0 | 84 |

It can be seen from these results that further improvements in the strength of the paper can be achieved by raising the proportion of starch but that the improvements become smaller as the proportion of starch is increased. Also when the proportion of starch was 20% by weight, based on the weight of clay, some starch was found in the "white water" i.e. the water which passed through the wire of the Fourdrinier paper making machine.

EXAMPLE 3

A further batch of paper was made by adding 2.5% by weight of the cationic starch containing tertiary amine groups, based on the weight of dry fibres, to the stock of cellulosic fibres, size and aluminium sulphate in stirred tank 1. In tank 10 there was mixed with the stock of treated fibres an aqueous suspension of the china clay filler which had been treated with a further 5% by weight of starch based on the weight of clay. In both tanks 1 and 10 sufficient energy was used in the mixing process just to set up a vortex and stirring was continued for two minutes after all the cationic starch had been added. The resultant mixture was formed into paper on the Fourdrinier paper making machine 15 and the percentage by weight of clay in the dry paper and the relative burst strength were determined. The percentage by weight of clay in the paper was 27% and for every 100 g of dry furnish (clay and cellulosic fibres) there were present 1.36 g of starch associated with the fibres and 1.35 g of starch associated with the clay filler, making a total of 2.71 g. The relative burst strength of the paper was 88%.

By comparison: (i) a paper containing the same percentage by weight of clay filler but prepared by the method of Example 1A (1.35 g of starch per 100 g of dry furnish) had a relative burst strength of 63%; (ii) a paper containing the same percentage by weight of clay filler but prepared by the method of Example 1B (1.46 g of starch per 100 g of dry furnish) had a relative burst strength of 61%; (iii) a paper containing the same percentage by weight of clay but prepared by the method of Example 1D (no starch) had a relative burst strength of 38%: and (iv) a paper containing the same percentage by weight of clay filler and prepared by the method of Example 1A but with a greater proportion of a starch (2.80 g of starch per 100 g of dry furnish) had a relative burst strength of 68%.

EXAMPLE 4

An aqueous stock containing 2% by weight of cellulosic fibres obtained by heating and refining a bleached sulphite pulp was mixed in a stirred tank with 1.5% by weight, based on the weight of dry fibres, of fortified rosin size and 3.0% by weight of powdered aluminium sulphate. The stock of sized fibres was then passed to a second tank where the stock was mixed with three times its own weight of water to dilute the suspension to 0.5% by weight of fibres.

In a third stirred tank there was mixed together water, china clay filler A in a flocculated state, and a cationic starch. The amount of energy used in the mixing was just sufficient to form a vortex, the mixing being continued for two minutes after all the stock had been added. (China clay filler A had a particle size distribution such that 31% by weight consisted of particles having an equivalent spherical diameter (e.s.d.) larger than 10 μm, 13% by weight consisted of particles having an e.s.d. smaller than 2 μm and 7% by weight consisted of particles having an e.s.d. smaller than 1 μm). The starch was added in the proportion 5% by weight, based on the weight of dry clay.

The flocculated mixture of clay filler A and starch was run to a further tank where it was mixed with the stock of sized cellulosic fibres in a given proportion so as to give a particular loading of china clay filler in the final dry paper. The resultant mixture was then passed to the head-box of a Fourdrinier paper making machine on which a web of paper was formed on the wire, dewatered and thermally dried. Further mixtures of china clay filler and starch and sized fibres in different proportions were prepared in a similar manner and formed into paper webs, dewatered and dried. Samples of the paper web for each loading of clay were weighed dry and then incinerated and the weight of ash was used to calculate the percentage by weight of clay in the dry paper, after allowing for the loss in ignitiion of the clay. Other samples of each paper were tested for burst strength by the test prescribed in TAPPI Standard T403-Os-74.

A further series of similar experiments was performed using a different china clay filler B which had a particle size distribution such that 25% by weight consisted of particles having an equivalent spherical diameter larger than 10 μm, 23% by weight consisted of particles having an equivalent spherical diameter smaller than 2 μm and 18% by weight consisted of particles having an equivalent spherical diameter smaller than 1 μm. Filler B was mixed with 5% by weight, based on the weight of dry clay, of the same cationic starch in the same manner as described above.

Further series of experiments were performed using china clay fillers A and B but no tertiary cationic starch. Aqueous suspensions of the two fillers were mixed directly with a suspension of fibres, rosin size and aluminium sulphate and webs of paper were formed and tested as above.

In each case the percentage by weight of clay filler in the filled paper was plotted against the burst ratio of the filled paper expressed as a percentage of the burst ratio for a sheet of paper prepared from the same fibre stock but containing no filler. The burst ratio is the burst strength divided by the weight per unit area of the paper. The percentage burst ratios corresponding to filler loadings of 10%, 15%, 20% and 30% by weight were then read from the graph for each series of experiments.

The results obtained are set forth in the Table III below.

| % by weight of filler (in total dry furnish) | % by weight of starch on furnish | % Burst ratio | | | |
|---|---|---|---|---|---|
| | | Treated with Cationic Starch | | Untreated | |
| | | Filler A | Filler B | Filler A | Filler B |
| 10 | 0.5 | 95 | 91 | 76 | 74 |
| 15 | 0.75 | 88 | 82 | 66 | 63 |
| 20 | 1.0 | 81 | 74 | 57 | 53 |

-continued

| % by weight of filler (in total dry furnish) | % by weight of starch on furnish | % Burst ratio | | | |
|---|---|---|---|---|---|
| | | Treated with Cationic Starch | | Untreated | |
| | | Filler A | Filler B | Filler A | Filler B |
| 25 | 1.25 | 74 | 65 | 50 | 45 |
| 30 | 1.5 | 67 | 57 | 43 | 37 |

These results show that not only do the fillers which have been treated with the cationic starch before mixing with the cellulosic fibres give papers of considerably higher burst strength as compared with papers containing equivalent quantities of the untreated fillers, but that also a treated china clay filler containing a small proportion of fine particles gives a further substantial and unexpected improvement in strength as compared with a treated conventional china clay filler.

EXAMPLE 5

An aqueous stock containing 0.5% by weight of sized cellulosic fibres derived from bleached sulphite pulp was prepared as described in Example 1. Water, kaolin clay filler in a flocculated state and a cationic starch containing tertiary amine groups were mixed together in a vessel of internal diameter ten inches which was provided with a propeller turbine of overall diameter five inches. The clay and cationic starch were the same as those used in Example 1 and the starch was added in the proportion 5% by weight, based on the weight of dry clay. The turbine was run for five minutes at a speed of 1500 r.p.m. and it was found that the moderate rate of shear thus provided was sufficient to ensure that substantially all of the mixture passed through a No. 200 mesh British Standard sieve and that from 15 to 20% by weight of the mixture was retained on a No. 300 mesh British Standard sieve. The flocculated mixture was then mixed with the stock of sized fibres in different proportions so as to give five different loadings of clay filler in the final dry paper, care being taken to ensure that the shear applied to the mixture was no more severe than that exerted during the preparation of the clay/starch mixture. For each loading of clay a web of paper was formed on the wire of the Fourdrinier paper making machine, dewatered and thermally dried. Samples of the web for each loading of clay filler were then tested for percentage by weight of clay in the dry paper and for burst strength as described in Example 1.

The experiment was then repeated except that the clay and cationic starch were mixed by hand stirring so that a low rate of shear was applied and the stock of sized fibres was mixed with the clay/starch mixture in a similar manner. When an attempt was made to pour the aqueous clay/starch mixture through a No. 200 mesh British Standard sieve it was found that a considerable proportion was retained in the sieve. The web of paper formed from the mixture were found on visual inspection to be unacceptable on account of the nonuniformity of the paper due to lumps of undispersed filler.

The experiment was repeated again except that the clay and cationic starch were mixed by means of the propeller turbine for five minutes at a speed of 7000 r.p.m., i.e. at a high rate of shear. The resultant mixture passed not only through a No. 200 mesh British Standard sieve but also substantially completely through a No. 300 mesh British Standard sieve (nominal aperture 53 μm) and it was clear that the clay/starch mixture was little, if any, coarser than the untreated clay filler. For each loading of clay a web of paper was formed on the wire of the Fourdrinier paper making machine, dewatered and thermally dried. Samples of the web for each loading of clay were then tested for percentage by weight of clay in the dry paper and for burst strength.

Finally, as a control, the experiment was repeated again except that no cationic starch was added. For each loading of clay a web of paper was formed on the wire of the Fourdrinier paper making machine, dewatered and thermally dried. Samples of the web for each loading of clay were then tested for percentage by weight of clay in the dry paper and for burst strength.

The results obtained are set forth in Table IV below. In each case the burst strength figures were expressed as a percentage of the burst strength of a sized paper web which contained no filler and no starch and the resultant relative burst strengths were plotted graphically against the percentage by weight of clay in the web. From the resultant graphs the relative burst strengths corresponding to loadings of 5%, 10%, 15%, 20% and 25% by weight of clay were found for each batch of paper.

TABLE IV

| Clay loading wt. % | 5 | 10 | 15 | 20 | 25 |
|---|---|---|---|---|---|
| | Relative burst strengths | | | | |
| Low shear | Paper unacceptable | | | | |
| Moderate shear | 95 | 89 | 83 | 77 | 70 |
| High shear | 94 | 87 | 80 | 71 | 62 |
| No Starch | 84 | 71 | 61 | 51 | 42 |

EXAMPLE 6

An aqueous stock containing 0.5% by weight of sized cellulosic fibres derived from bleached sulphite pulp was prepared as described in Example 1.

An aqueous suspension containing 30% by weight of kaolin clay filler in a flocculated state and an aqueous solution containing 5% by weight of a cationic starch containing tertiary amine groups were mixed together by pumping the two streams through an in-line static mixer comprising a tube of internal diameter 5 mm provided with curved baffles which were designed to divide the stream flowing through the tube and cause turbulence. The proportions were such that there were present in the mixed suspension five parts by weight of starch per hundred parts by weight of clay, the clay filler suspension being pumped through the in-line mixer at a rate of 271 milliliters per minute and the cationic starch solution being pumped through the in-line mixer at a rate of 100 milliliters per minute. The clay filler had a particle size distribution such that 43% by weight consisted of particles having an equivalent spherical diameter smaller than 2 microns and 13% by weight consisted of particles having an equivalent spherical diameter larger than 10 microns. It was found that the moderate shear provided by the in-line static mixer was sufficient to ensure that substantially all of the mixture passed through a No. 200 mesh British Standard sieve. A sample of the mixture, which was examined under an optical microscope, was found to have a floc size distribution such that 5% by weight of the flocs had a diameter smaller than 10 microns, 55% by weight had a diameter smaller than 30 microns and 2% by weight had a diameter larger than 60 microns.

The flocculated mixture was then mixed with the stock of cellulosic fibres in different proportions so as to give three different loadings of clay filler in the final dry paper, care being taken to ensure that the shear applied to the mixture was no more severe than that exerted during the preparation of the clay/starch mixture. For each loading of clay a web of paper was formed on the wire of a pilot-scale Fourdrinier paper making machine, dewatered and thermally dried. Samples of the web for each loading of clay filler were then tested for percentage by weight of clay in the dry paper and for burst strength as described in Example 1.

The experiment was then repeated except that the clay and cationic starch were mixed by gentle hand stirring so that low shear was applied and the stock of sized fibres mixed with the clay/starch mixture in a similar manner. It was found that a substantial proportion of the mixture was retained on a No. 200 mesh British Standard sieve and a sample of the mixture, examined under an optical microscope, following the procedure set out in British Standard 3406: Part 4, 1963, was found to have a floc size distribution such that 1% by weight of the flocs had a diameter smaller than 10 microns, 21% by weight had a diameter smaller than 30 microns and 30% by weight had a diameter larger than 60 microns. The webs of paper formed from the mixture were found on visual inspection to be unacceptable because white granules of undispersed filler could be seen in the surface of the paper and on holding the paper up to the light these granules appeared dark.

The experiment was repeated again except that the clay suspension and cationic starch solution were mixed by means of a shrouded impeller mixer rotating at 300 r.p.m. for 5 minutes resulting in a high shear being applied to the suspension. The resultant mixture passed completely through a No. 300 mesh British Standard sieve and a sample of the mixture examined under an optical microscope was found to have a floc size distribution such that 23% by weight of the flocs had a diameter smaller than 10 microns, 82% by weight had a diameter smaller than 30 microns and 0.5% by weight had a diameter larger than 60 microns. Samples of the web of paper formed for each loading of clay filler were tested for percentage by weight of clay in the dry paper and for burst strength.

Finally, as a control, the experiment was repeated again with moderate shear except that no cationic starch was added. Samples of the web of paper formed for each loading of clay filler were tested for percentage by weight of clay in the dry paper and for burst strength.

The results obtained are set forth in Table V below. In each case the burst strength figures were expressed as a percentage of the burst strength of a sized paper web which contained no filler and no starch and the resultant relative burst strengths were plotted graphically against the percentage by weight of clay in the dry paper. From the resultant graphs the relative burst strengths corresponding to filler loadings of 5%, 10%, 15%, 20% and 25% by weight of clay were found for each batch of paper.

TABLE V.

| Clay filler loading wt % | 5 | 10 | 15 | 20 | 25 |
|---|---|---|---|---|---|
| | Relative burst strengths | | | | |
| Low shear | Paper unacceptable | | | | |
| Moderate shear | 100 | 97 | 90 | 83 | 76 |
| High shear | 97 | 88 | 79 | 69 | 60 |
| No starch | 87 | 76 | 65 | 50 | 45 |

EXAMPLE 7 (Comparison)

An aqueous stock containing 0.5% by weight of sized cellulosic fibres derived from bleached sulphite pulp was prepared as described in Example 1.

Water, kaolin clay filler in a flocculated state and a mannogalactan, guar gum, were mixed together with moderate shear conditions in proportions such as to form firstly a mixture containing 1% by weight of guar gum based on the weight of clay and secondly a mixture containing 5% by weight of guar gum based on the weight of clay. The clay had a particle size distribution such that 43% by weight consisted of particles having an equivalent spherical diameter smaller than 2 microns and 13% by weight consisted of particles having an equivalent spherical diameter larger than 10 microns. (The guar gum was added in the form of an aqueous dispersion which was prepared by mixing 5 parts by weight of anhydrous guar gum powder with 100 parts by weight of water at 20°-30° C., heating the mixture slowly to 80° C. with constant stirring, maintaining the mixture at 80° C. for 15 minutes again with constant stirring, and then allowing the mixture to cool to room temperature.) It was found that a sample taken from each of the two mixtures prepared as described above passed substantially completely through both No. 200 and No. 300 mesh British Standard sieves.

Each of the two mixtures were then blended with part of the stock of cellulosic fibres in different proportions so as to give three different loadings of clay filler in the final dry paper. Handsheets were prepared according to TAPPI Standard No. T205-os-71 for each loading of clay and samples of the dry handsheet for each loading of clay filler were then tested for the percentage by weight of clay in the dry paper and for burst strength as described in Example 1.

Handsheets were also prepared from mixtures containing cellulosic fibres and varying amounts of clay filler but no guar gum, and again samples of these handsheets were tested for the percentage by weight of clay in the dry paper and for burst strength.

The results obtained are set forth in Table VI below. In each case the burst strength figures were expressed as a percentage of the burst strength of a sized paper web which contained no filler and no guar gum and the resultant relative burst strengths were plotted graphically against the percentage by weight of clay in the dry paper. From the resultant graphs the relative burst strengths corresponding to clay filler loadings of 5%, 10%, 15%, 20% and 25% by weight of clay were found for each batch of paper.

TABLE VI.

| Clay filler loading wt % | 5 | 10 | 15 | 20 | 25 |
|---|---|---|---|---|---|
| | Relative burst strengths | | | | |
| No guar gum | 88 | 76 | 66 | 57 | 48 |
| 1% by wt. of guar gum | 88 | 76 | 66 | 57 | 48 |
| 5% by wt. of guar gum | 90 | 80 | 71 | 60 | 46 |

These results show that the use of 1% by weight of guar gum, based on the weight of dry clay, gave no improvement at all in the strength of the filled paper, while the use of 5% by weight of guar gum gave a barely significant improvement which, by comparison with Table V above, can be seen to be very much less than would be obtained by the method of the invention.

I claim:

1. A method of manufacturing a paper or cardboard product of improved strength characteristics which method comprises in sequence the steps of mixing an aqueous solution or dispersion of a cationic starch which contains primary, secondary or tertiary amino groups or quaternary ammonium groups and has a nitrogen content ranging from about 0.1 to about 0.25% by weight, with an aqueous suspension of a kaolinitic clay filler which contains not more than 50% by weight of particles smaller than 2 microns and not more than 35% by weight of particles smaller than 1 micron, to form a mixture containing flocs consisting essentially of starch and clay filler; thereafter adding the mixture thus obtained to an aqueous stock of cellulosic fibres to form a furnish containing the flocs of starch and clay filler, and the cellulosic fibres; and then forming the furnish into a paper or cardboard product; wherein the product of the rate at which shear is applied to, and the period for which the shear is applied to, said flocs during the formation of said mixture and said furnish is such that the flocs are reduced in size sufficiently to enable substantially all of the mixture to pass through a No. 200 mesh British Standard sieve but not so much that more than 90% of the mixture can pass through a No. 300 mesh British Standard sieve.

2. A method according to claim 1, wherein the amount of shear to which the flocs of starch and clay filler are exposed is such that the flocs have a size distribution such that not more than 15% by weight of the flocs have a diameter smaller than 10 microns and not more than 20% by weight of the flocs have a diameter larger than 60 microns.

3. A method according to claim 2, wherein the amount of shear to which the flocs of starch and clay filler are exposed is such that the flocs have a size distribution such that from 30% to 80% of the flocs have a diameter smaller than 30 microns and not more than 10% by weight of the flocs have a diameter smaller than 10 microns.

4. A method according to claim 1, wherein the kaolinitic clay filler contains not more than 18% by weight of particles having an equivalent spherical diameter smaller than 2 μm, and not more than 10% by weight of particles having an equivalent spherical diameter smaller than 1 μm.

5. A method according to claim 1, wherein the clay filler contains not more than 25% by weight of particles larger than 10 microns.

6. A method according to claim 1, wherein the cationic starch is mixed with the aqueous stock of cellulosic fibres before there is added to the aqueous stock of cellulosic fibres the mixture of the aqueous suspension of kaolinitic clay filler and cationic starch.

7. A method according to claim 1, wherein the quantity of cationic starch present in said furnish is in the range of from 0.5 g to 5.0 g per 100 g of kaolinitic clay filler and cellulosic fibres.

8. A method according to claim 1, wherein the amount of clay filler used is such that there is present in said furnish at least 20% by weight of clay filler, calculated on a dry weight basis.

* * * * *